US006454881B1

(12) United States Patent
Hase et al.

(10) Patent No.: US 6,454,881 B1
(45) Date of Patent: Sep. 24, 2002

(54) NON-REFINED STEEL BEING REDUCED IN ANISOTROPY OF MATERIAL AND EXCELLENT IN STRENGTH, TOUGHNESS AND MACHINABILITY

(75) Inventors: Kazukuni Hase; Yasuhiro Omori; Toshiyuki Hoshino; Keniti Amano, all of Okayama (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/979,506

(22) PCT Filed: Mar. 22, 2001

(86) PCT No.: PCT/JP01/02272

§ 371 (c)(1),
(2), (4) Date: Nov. 23, 2001

(87) PCT Pub. No.: WO01/71050

PCT Pub. Date: Sep. 27, 2001

(30) Foreign Application Priority Data

Mar. 24, 2000 (JP) ..... 2000-083503

(51) Int. Cl.[7] ..... C22C 38/20; C22C 38/42; C21D 7/13

(52) U.S. Cl. ..... 148/332; 148/333; 148/334; 148/335; 148/654; 420/90

(58) Field of Search ..... 420/112, 90, 114, 420/110, 109, 106, 104; 148/335, 334, 333, 332, 654

(56) References Cited

U.S. PATENT DOCUMENTS 5,922,145 A 7/1999 Watari et al. ..... 148/320
6,162,389 A * 12/2000 Hase et al. ..... 148/332

FOREIGN PATENT DOCUMENTS

JP 9-170047 6/1997

* cited by examiner

*Primary Examiner*—Deborah Yee
(74) *Attorney, Agent, or Firm*—Young & Thompson

(57) ABSTRACT

Provided is a non heat-treated steel that requires no particular controls over cooling rates and no aging treatments after hot working, that can sufficiently increase tensile strength, yield strength and toughness even at lightly deformed parts, and furthermore, that has excellent material anisotropy and machinability as an alloy steel for machine structures. In other words, it is a non heat-treated steel that contains: C: more than 0.05 mass % to less than 0.10 mass %; Si: 1.0 mass % or less; Mn: more than 2.2 mass % to 5.0 mass %; S: less than 0.020 mass %; Cu: more than 1.0 mass % to 3.0 mass %; Ni: 3.0 mass % or less; Cr: 0.01 to 2.0 mass %; Al: 0.1 mass % or less; Ti: 0.01 to 0.10 mass %; B: 0.0003 to 0.03 mass %; N: 0.0010 to 0.0200 mass %; O: 0.0060 mass % or less; and the balance Fe and inevitable impurities, and that the steel structure is bainitic having block structures at 10% or more in area ratios.

10 Claims, 5 Drawing Sheets

NON-REFINED STEEL BEING REDUCED IN ANISOTROPY OF MATERIAL AND EXCELLENT IN STRENGTH, TOUGHNESS AND MACHINABILITY

TECHNICAL FIELD

The present invention relates to a non heat-treated steel which is particularly useful as steel for machine structures and which has small material anisotropy and excellent strength, toughness and machinability, and the production thereof. Furthermore, the non heat-treated steel is one that is used as it is after hot working.

BACKGROUND ART

Many structural parts of vehicles and industrial machines require high strength and toughness. In manufacturing these parts, SCM435 (JIS) or SCM440 (JIS) and the like were conventionally used as alloy steel for machine structure. Furthermore, in order to add strength and toughness, heat treatment such as hardening-tempering was carried out after molding by hot working.

However, the heat treatment not only requires time but is also costly. Thus, if such heat treatment can be skipped, costs can be cut significantly, and it is also highly advantageous in saving energy.

Thus, various types of non heat-treated steel that require no heat treatment were conventionally proposed.

For example, ferritic-pearlistic non heat-treated steel which contains Mn and in which about 0.10 mass % of V is added to medium carbon steel having 0.3 to 0.5 mass % of C has been proposed. In the steel, the strength of ferrite is increased by precipitating VC or VN during cooling after hot rolling, and furthermore, the strength of pearlite is also increased, thus increasing the strength of the entire steel.

However, the ferritic-pearlistic non heat-treated steel uses 0.3 to 0.5 mass % of C which exists as cementite in pearlite to increase strength. Thus, it has been difficult to balance tensile strength and toughness. Moreover, in order to obtain stable quality, it is necessary to control cooling rates after hot rollng within an extremely narrow range, and handling becomes complex.

Moreover, Japanese Examined Patent Application Publication No. 6-63025 and Japanese Unexamined Patent Application Publication No. 4-371547 disclose bainitic or martensitic hot forged non heat-treated steel in which Mn, Cr or V and the like is added to low carbon steel having 0.05 to 0.3 mass % of C.

The bainitic non heat-treated steel and martensitic non heat-treated steel were proposed to supplement toughness. Although these steels have sufficient toughness for small parts, toughness is incomplete for big parts when a cooling rate is low. In other words, a cooling rate after hot working has to be controlled high, and handling becomes complex.

Furthermore, in conventional bainitic non heat-treated steels, crystal grains are not refined during hot working at working-free parts. As a result, there was a problem in that there is less toughness at lightly deformed parts than at heavily deformed parts. There was also a problem in that a yield ratio is low.

The present invention is to advantageously solve the above-noted problems. In other words, the object of the present invention is to present a non heat-treated steel that can maintain strength without particular controls over cooling rates and without aging treatments after hot working, that has significantly higher tensile strength, yield strength and toughness even at nearly working-free parts, and furthermore, which has excellent material anisotropy and machinability, and the production thereof.

DISCLOSURE OF THE INVENTION

The present inventors, in order to achieve the object mentioned above, carried out thorough researches. As a result, the following knowledge was obtained.

(1) When block structures are formed in a bainitic structure, toughness of the steel is improved even if the micro-structure is a bainite transformed from coarse austenite grain. FIG. 1 shows the bainitic structure of the present invention in pattern. 1 indicates an former austenite grain boundary, and 2 is a block structure. The block structures are fine lath structures that are in nearly the same crystallographical orientation. As shown in FIG. 1, bainite surrounded by the former austenite grain boundary is subdivided by block structures, improving toughness.

(2) It is effective to add Mn, Cu, Cr and B, particularly, Mn and Cu to accelerate the formation of block structures in a bainitic structure. Accordingly, toughness is high even at insufficiently worked parts.

(3) The yield strength of steel can be increased by precipitating Cu in steel. Moreover, by adding Cu, not only can strength sharply increase even when a cooling rate is low, but machinability also improves by additionally adding S in an appropriate content. In other words, both strength and machinability can be high.

(4) S was conventionally added to improve machinability. MnS with excess S is stretched out during rolling, and exists in a bar form in steel. The MnS causes material anisotropy, which made it difficult to improve machinability and to reduce material anisotropy at the same time. However, since a required S content is kept to improve machinability by adding Cu, the addition of excessive S becomes unnecessary and the formation of a bar-form MnS can be prevented. In other words, it is possible to improve machinability and reduce material anisotropy at the same time.

(5) A hardening property improves due to the addition of Mn, Ni, Cr, B and the like. High strength and toughness can be obtained without heat treatment after hot rolling.

The present invention is based on the above-noted knowledge. In other words, presented is a non heat-treated steel that has small material anisotropy, and excellent strength, toughness and machinability, containing: C: more than 0.05 mass % to less than 0.10 mass %; Si: 1.0 mass % or less; Mn: more than 2.2 mass % to 5.0mass %; S: less than 0.020 mass %; Cu: more than 1.0 mass % to 3.0 mass %; Ni: 3.0 mass % or less; Cr: 0.01 to 2.0 mass %; Al: 0.1 mass % or less; Ti: 0.01 to 0.10 mass %; B: 0.0003 to 0.03 mass %; N: 0.0010 to 0.0200 mass %; 0: 0.0060 mass % or less; and the balance Fe and inevitable impurities. The steel structure is bainite having block structures at 10% or more in area ratios. It is also a production of the non heat-treated steel having small material anisotropy and excellent strength, toughness and machinability in which hot working is carried out at 850° C. or above at 30% or more total reduction of cross-sectional area after heating the steel at 1000 to 1250° C., and the steel is cooled at a cooling ratio of 0.001 to 1° C./s in the temperature range of 600 to 300° C.

Furthermore, in order to improve the quality of material, it is also possible to contain one kind or two kinds of microelements selected from the group consisting of Mo, Nb, V, W, Zr, Mg, Hf, REM, P, Pb, Co, Ca, Te, Se, Sb and Bi.

BEST MODE FOR CARRYING OUT THE INVENTION

The results of experiments that resulted in the present invention will be explained below.

A plurality of steel blooms having various contents of components shown in Table 1 were manufactured by continuous casting. After the steel blooms were heated to 1100° C., steel bars of 100 mmϕ were provided by hot rolling. After the hot rolling, the steel bars were cooled at the cooling rate of 0.5° C./s or 10° C./s in the temperature range of 600 to 300° C. Various tests were carried out on the steel bars.

TABLE 1

(mass %)

| C | Si | Mn | S | Cu | Ni | Cr | Al | Ti | B | N | O |
|---|---|---|---|---|---|---|---|---|---|---|---|
| 0.07 to 0.10 | 0.2 to 0.3 | 2.9 to 3.1 | 0.001 to 0.10 | 0.5 to 3.0 | 1.30 to 1.40 | 0.5 to 0.6 | 0.025 to 0.050 | 0.015 to 0.025 | 0.0010 to 0.0035 | 0.0035 to 0.0050 | 0.001 to 0.004 |

Figure 1:
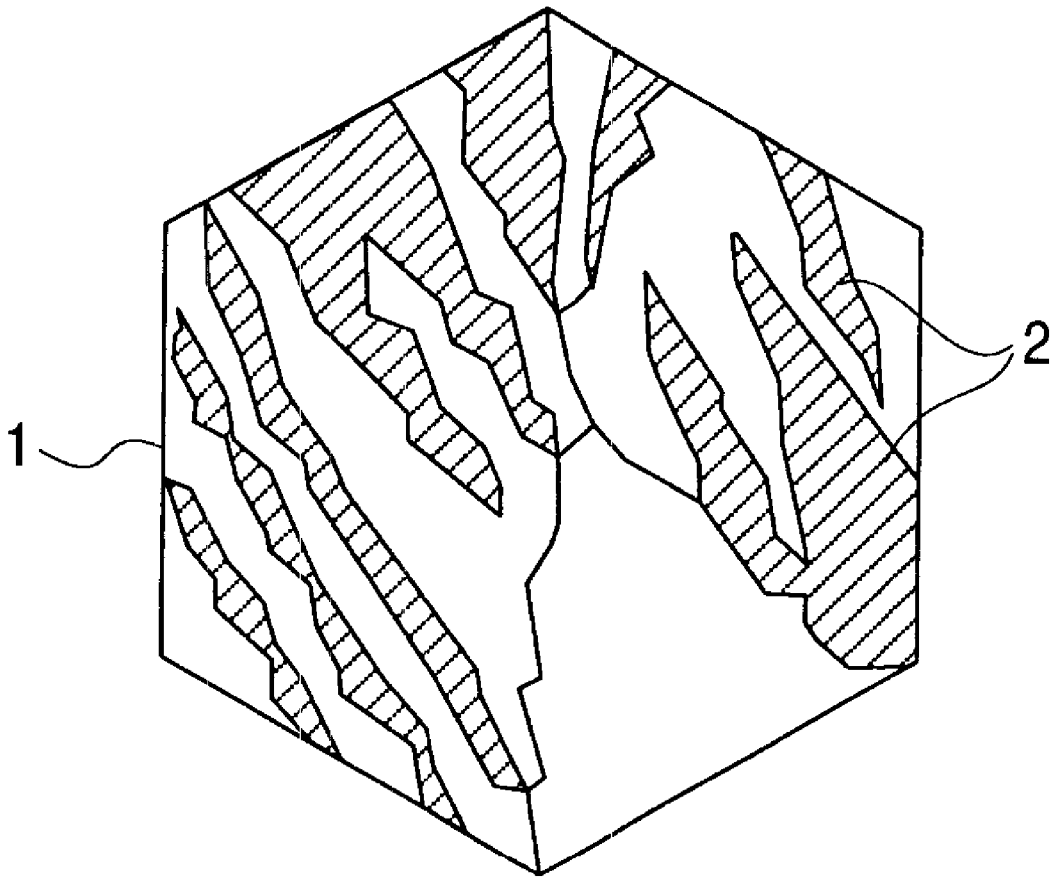
FIG. 1 is a figure, showing the formation of block structures in bainite.
Figure 2:
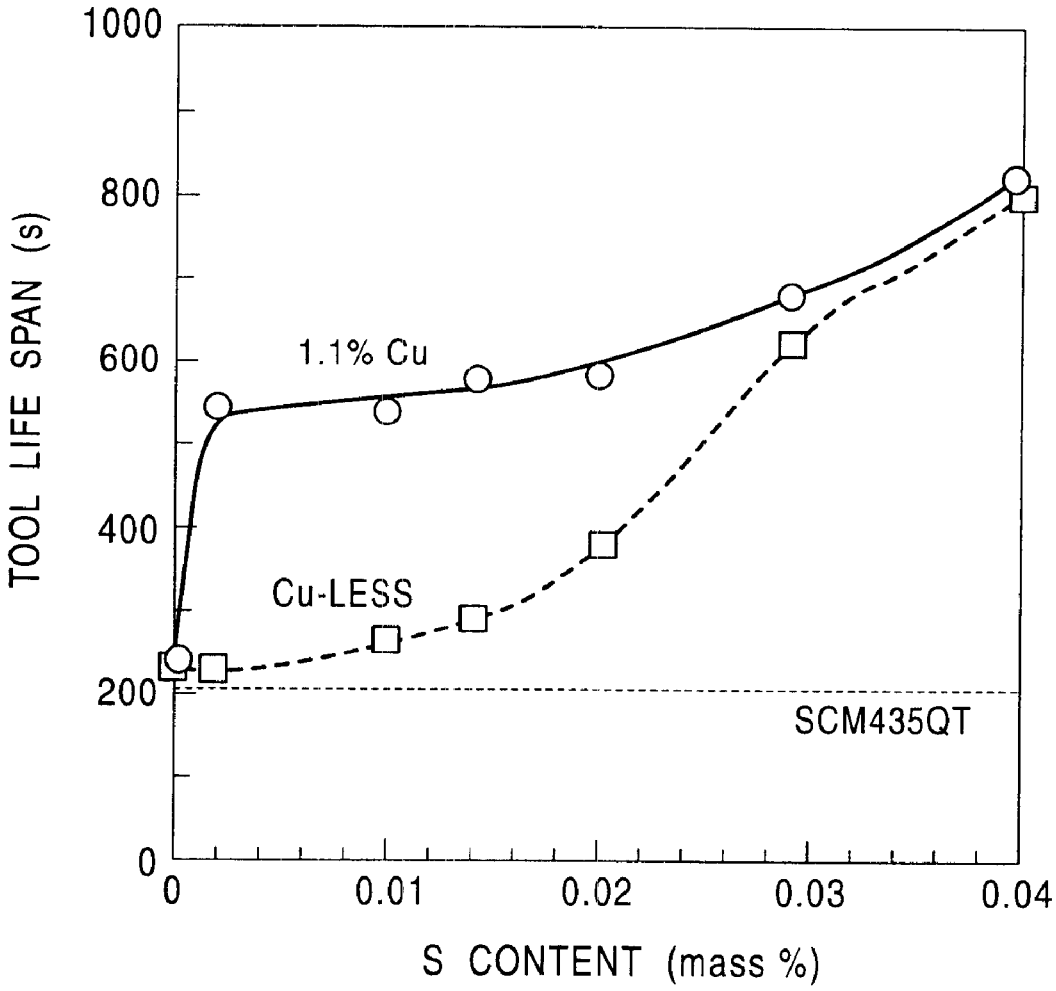
FIG. 2 is a graph, showing the effects of Cu and S in steel on machinability.

FIG. 2 shows the test results of the effects of Cu and S in steel on machinability. In FIG. 2, the solid line shows the results of the steel containing Cu at 1.1 mass %, and the broken line shows the results of the steel containing no Cu. The testing steels were cooled at the cooling rate of 0.5° C./s in the temperature range of 600 to 300° C. after hot rolling. Machinability was evaluated on the basis of tool life span as a total machining period in which the wear amount of a flank wear is 0.10 mm. When the flank wear amount of a tool is reduced, it is surmised that tool life span is extended and machinability is superior. Furthermore, cutting was carried out by using a carbide tool under the conditions of 300 m/min in cutting speed, 0.20 mm/rev in feed amounts, 1 mm of cuts. In comparison, the tool life span of conventional steel, SCM435QT of JIS G4105, in peripheral cutting was indicated as a dotted line.

As shown in FIG. 2, tool life span improves as Cu is added. The improvement is obvious particularly when S is contained at 0.002 to 0.02 mass %. Moreover, in order to obtain the tool life span that is longer than about twice as long as that of the conventional steel, S may be added at 0.002 mass % or more when Cu is contained.

Thus, it is assumed that tool life span increases significantly by adding Cu and S due to the belag effect of Cu sulfide observed at the wear surface of the flank.

When the steel was cooled at 10° C./s in the temperature range of 600 to 300° C. after hot rolling, the improvement of machinability was not as great as the improvement that was obtained when the steel was cooled at 0.5° C./s. Furthermore, relations between cooling ratios and tool lifespan were examined. The improvement of tool lifespan due to the addition of Cu and S is obvious when the cooling rate is 1° C./s or below.

Figure 3:
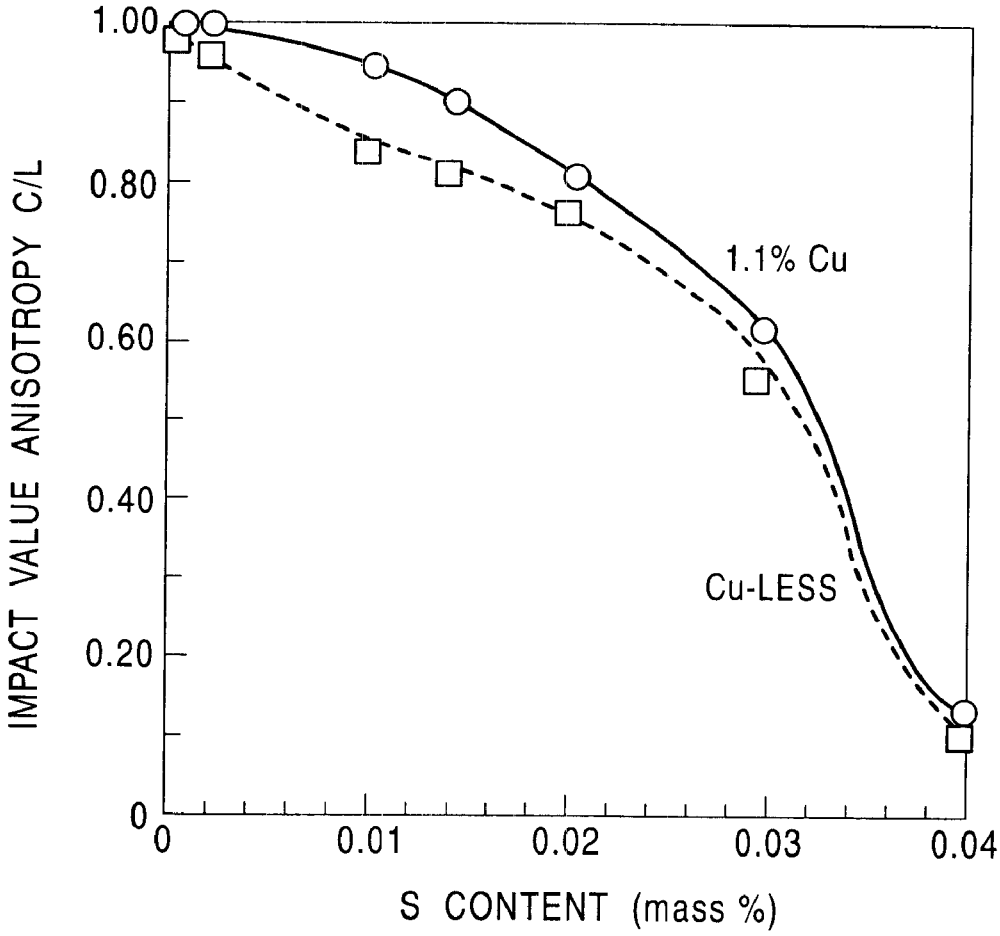
FIG. 3 is a graph, showing the effects of Cu and S in steel on impact value anisotropy after rolling.

Subsequently, FIG. 3 shows the test results of the effects of Cu and S in steel on impact value anisotropy after hot rolling.

In FIG. 3, the solid line and the broken line shows the results of the steel containing Cu at 1.1 mass %, and the results of the steel containing no Cu, respectively. The testing steels were cooled at the cooling rate of 0.5° C./s in the temperature range of 600 to 300° C. after hot rolling. JIS No. 3 impact test pieces were cut out from the L direction and C direction. U notches were added. Each Charpy impact absorption energy at 20° C. was measured, and ratios were calculated.

As shown in FIG. 3, the ratios of impact values between the L direction and C direction are nearly 1 due to the addition of Cu. It is particularly obvious when S is contained at 0.002 to 0.2 mass %. In order to obtain the ratios of impact values between the L direction and C direction at 80% or above, it is necessary to limit S to less than 0.020 mass %. Moreover, particularly in order to obtain the ratios of impact values between the L direction and C direction at 90% or above, it is necessary to limit S to 0.014 mass % or less.

It is known that material anisotropy is mostly apparent in impact value anisotropy. Thus, based on the results, in order to reduce material anisotropy in the L direction and C direction, it is necessary to add Cu and control S at less than 0.020 mass %, preferably, 0.14 mass % or less.

Figure 4:
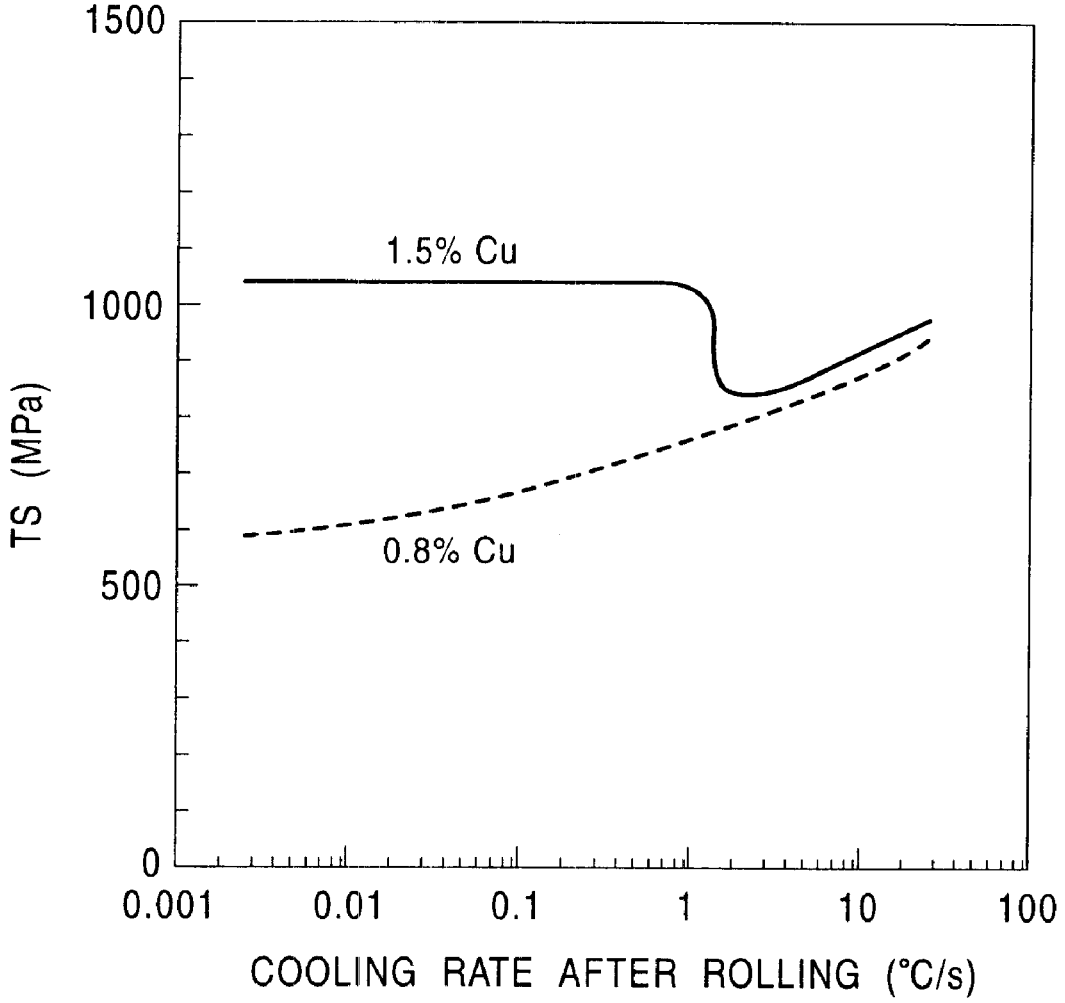
FIG. 4 is a graph, showing the effects of cooling rates after rolling on tensile strength with Cu contents in steel as parameters.

Subsequently, FIG. 4 shows the test results of the effects of cooling ratios in the temperature range of 600 to 300° C. after hot rolling on tensile strength. In FIG. 4, the solid line and the broken line show the results of the steel containing Cu at 1.5 mass %, and the results of the steel containing Cu at 0.8 mass %, respectively. The S content was 0.013 mass %. Tensile strength was measured from the tensile tests of cut out JIS NO. 4 tensile test pieces.

As shown in FIG. 4, when the cooling rate is 1° C./s or below in the temperature range of 600 to 300° C. after hot rolling, the steel containing Cu at 1.5 mass % has higher TS than the steel containing Cu at 0.8 mass %. High tensile strength of about 1000 MPa was obtained, This is because fine Cu precipitated during cooling after hot rolling, which effectively increased strength.

In general hot working, cooling ratios after working are 1° C./s or below. In other words, it is realized that the steels having Cu can be strengthened without particular controls over cooling ratios after rolling and without heat treatment.

Additionally, in case of steels having no Cu, there was a problem in that structures are softened and strength becomes insufficient when cooling ratios are low, as with large-diameter steel bars and the like.

In this sense, as shown in FIG. 4, the structures of the steels containing Cu are softened a little due to precipitation strengthening of Cu even when cooling ratios are low, and stable strength can be obtained. Thus, the steels are applicable to a wide range of sizes from small to large diameters.

Figure 5:
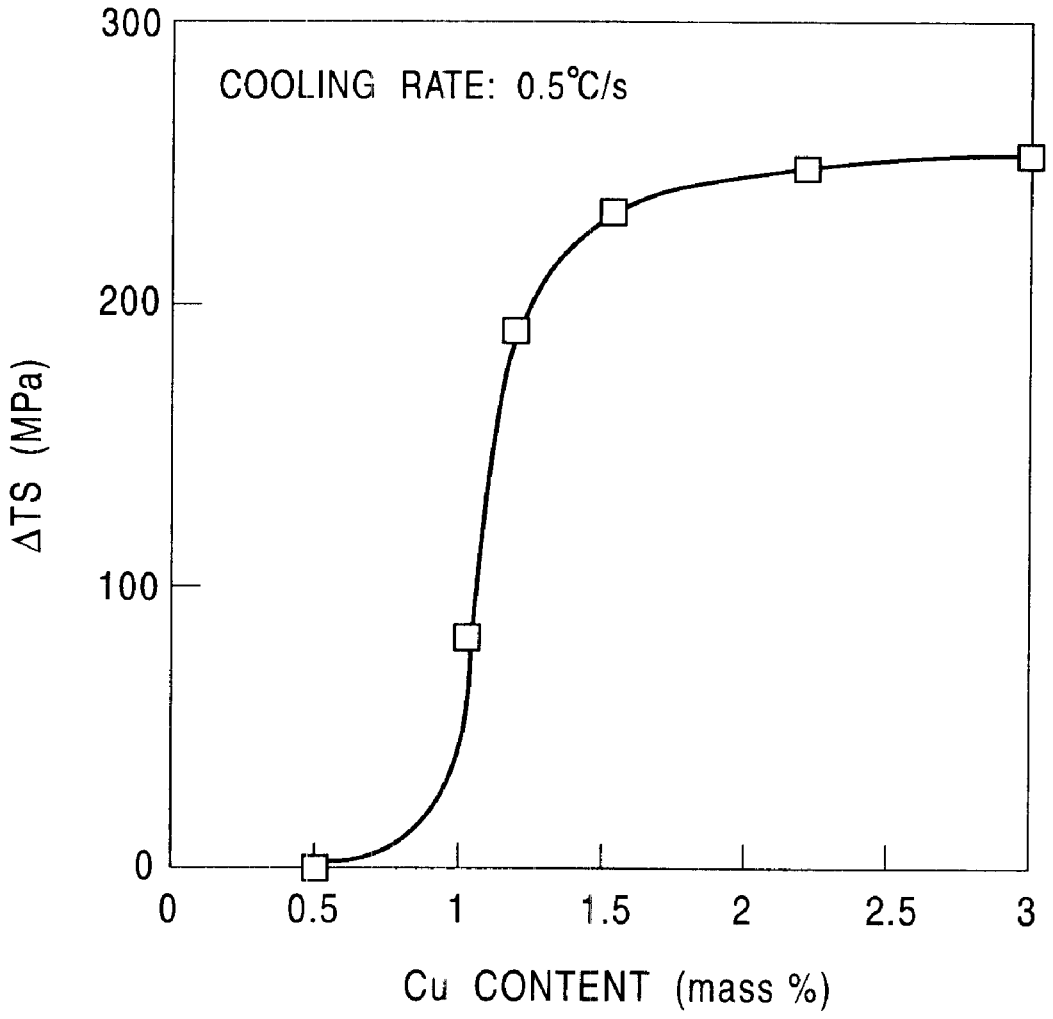
FIG. 5 is a graph, showing the effects of Cu content in steel on the increase in strength.

FIG. 5 shows the test results of the effects of Cu content in steel on the increase in strength. Additionally, the S content is 0.013 mass %, and the cooling ratio in the temperature range of 600 to 300° C. after hot rolling is 0.5° C./s. ΔTS is a difference in tensile strength between steel containing Cu and steel containing no Cu.

As shown in FIG. 5, when the Cu content exceeds 1.0 mass %, ΔTS increases sharply. Particularly, when Cu ≧1.5 mass %, strength increases by about 250 MPa.

Subsequently, the reasons why the compositions of the steel are limited to the above-noted ranges will be explained.

C: More Than 0.05 Mass % to Less Than 0.10 Mass %

C is an important element to maintain strength and to form block structures in a bainitic structure. Thus, it is necessary to add C at more than 0.05 mass %. On the other hand, when C is contained at 0.10 mass % or more, the structure becomes martensitic, and toughness is lost. Thus, the content was less than 0.10 mass %.

Si: 1.0 Mass % or Less

Si is an useful element f or deoxidation and solid-solution strengthening. However, when Si is added excessively, toughness declines. Thus, the content is limited to 1.0 mass % or less.

Mn: More Than 2.2 Mass % to 5.0 Mass %

Mn improves a hardening property, and is an important element to form block structures in a bainitic structure. Due to the effects, it is necessary to contain Mn at more than 2.2 mass % in order to maintain strength and toughness. However, when the content exceeds 5.0mass %, a cutting property declines. Thus, the content is limited to the range of more than 2.2 to 5.0 mass %.

S: Less Than 0.020 Mass %

S is an element to improve a cutting property particularly with the addition of Cu. To obtain the effect, the content of 0.002 mass % or more is preferable. However, when the content is excessive, MnS is formed, causing material anisotropy. Thus, the content is limited to less than 0.020 mass %.

Cu: More Than 1.0 Mass % to 3.0 Mass %

Cu is an element to strengthen the steel and to improve machinability by the addition of S. Furthermore, Cu accelerates the formation of block structures in a bainitic structure, and improves toughness. In order to achieve these effects, Cu needs to be contained at more than 1.0 mass %. On the other hand, when the content exceeds 3.0 mass %, toughness declines sharply. Thus, the content is limited to the range of more than 1.0 to 3.0 mass %. More preferably, the content is in the range of 1.5 to 3.0 mass %.

Ni: 3.0 Mass % or Less

Ni is an effective element for improving strength and toughness. Moreover, when Cu is added, it is also effective in preventing hot cracking during rolling. However, it is expensive, and the effects would not improve even if it is added excessively. Thus, the content is limited to 3.0 mass % or less.

Cr: 0.01 to 2.0 Mass %

Cr is an effective element for improving a hardening property. It is also a highly effective element to reduce the effects of cooling rates after hot working, on strength and toughness. Furthermore, it is also effective to increase the volume fraction of block structures in bainite after hot rolling. However, when the content is below 0.01 mass %, the effects are negligible. On the other hand, when Cr is added in a large content at more than 2.0 mass %. toughness declines. Thus, Cr is limited to the range of 0.01 to 2.0 mass %.

Al: 0.1 Mass % or Less

Al is effective as a deoxidizer. However, when the content exceeds 0.1 mass %, alumina inclusion increases. As a result, not only is toughness lost, but machinability also declines. Thus, the content is limited to 0.1 mass % or less.

Ti: 0.01 to 0.10 Mass %

Ti is a precipitation strengthening element. Furthermore, Ti forms TiN along with N, contributing to the refining of structures. Ti is an effective element to improve toughness.

It also functions as a deoxidizer. Thus, it is added at 0.01 mass % or more. On the other hand, when it is added excessively, rough and large TiN is precipitated and toughness declines instead in the case of slow cooling rates. Thus, the upper limit is 0.1 mass %.

B: 0.0003 to 0.03 Mass %

B is an effective element to improve a hardening property. It is also an effective element to reduce the effects of cooling rates on strength and toughness. It is also effective to increase the volume fraction of block structures in bainite after hot rolling. In order to achieve the effects, it is necessary to add at 0.0003 mass % or more. On the other hand, even when it is added excessively, the effects do not improve. Thus, the upper limit is 0.03 mass %.

N: 0.0010 to 0.0200 Mass %

N forms TiN along with Ti and precipitates. It works as a pinning site that prohibits the growth of crystal grains during heating such as hot casting. As a result, it functions to refine structures and improve toughness. However, when N is less than 0.0010 mass %, the effects due to the precipitation of TiN cannot be fully achieved. On the other hand, even though N is added at more than 0.0200mass %, the effects do not improve.

Furthermore, solid-solution N rather decreases the toughness of a steel material. Thus, N is limited to the range of 0.0010 to 0.0200 mass %.

0: 0.0060 Mass % or Less

O reacts to a deoxidizer during melting, forming oxide. When the oxide is not completely removed, it remains in steel. When O exceeds 0.0060 mass %, the residual oxide increases and toughness declines sharply. Thus, O is controlled at 0.0060 mass % or less. More preferably, the content is 0.0045 mass % or less.

In the invention, it is possible to add the following microelements in addition to the above-noted essential components.

As elements to improve a hardening property and improve strength, Mo and Nb can be added in the following ranges.

Mo: 1.0 Mass % or Less

Mo is effective to improve strength at ordinary temperature and high temperature. However, when it is added excessively, costs increase. Thus, it is limited to the range of 1.0 mass % or less. Additionally, in order to achieve the improvement of strength, it is preferably contained at 0.05 mass % or more.

Nb: 0.5 Mass % or Less

Nb improves not only a hardening property but also precipitation hardening and toughness. However, when it is added at more than 0.5 mass %, hot workability is obstructed. Thus, it is contained at 0.5 mass % or less.

As strength improving components, V and W can be added in the following ranges.

V: 0.5 Mass % or Less

VC and VN are used for precipitation strengthening. Furthermore, as VC and VN precipitated in austenite are used as nuclei for forming bainite, structures can be refined and toughness can improve. However, when V is added at more than 0.5 mass %, the effects do not improve, causing problems such as cast cracking. Thus, V is contained at 0.5 mass % or less.

W: 0.5 Mass % or Less

W is effective to increase strength due to solid-solution strengthening. Furthermore, W reacts to C, precipitating WC and effectively contributing to the increase in strength. However, when W is added at more than 0.5 mass %, toughness declines sharply. Thus, W is contained at 0.5 mass % or less.

Furthermore, the following elements can be contained in order to refine crystal grains and improve toughness.

Zr: 0.02 Mass % or Less

Zr is not only a deoxidizer but also a useful element to refine crystal grains and improve strength and toughness. However, even if it is contained at more than 0.02 mass %, the effects do not improve. Thus, Zr is contained at 0.02 mass % or less.

Mg: 0.02 Mass % or Less

Mg is not only a deoxidizer but also a useful element to refine crystal grains and improve strength and toughness. However, even if it were contained at more than 0.02 mass %, the effects would not improve. Thus, Mg is contained at 0.02 mass % or less.

Hf: 0.10 Mass % or Less

Hf is effective to refine crystal grains and improve strength and toughness. However, even if it were contained at more than 0.10 mass %, the effects would not improve. Thus, Hf is contained at 0.10 mass % or less.

REM: 0.02 Mass % or Less

REM is effective to refine crystal grains and improve strength and toughness. However, even if it were contained at more than 0.02 mass %, the effects would not improve. Thus, REM is contained at 0.02 mass % or less.

Furthermore, as elements to improve a cutting property, one or two kinds of P, Pb, Ca, Te, Co, Se, Sb and Bi can be contained in the following range, respectively.

P 0.10 Mass % or Less

In order to improve a cutting property, it is possible to add P. However, since it provides negative effects on toughness or fatigue strength, P should be contained at 0.10 mass % or less. Preferably, the content is 0.07 mass % or less.

Pb: 0.30 Mass % or Less

Pb has a low melting point, and is an element having liquid lubricating effects and which can improve a cutting property when it is melted by heating a steel material during cutting. However, the effects would not improve when the content exceeds 0.30mass %, reducing fatigue resistance. Thus, Pb is contained at 0.30 mass % or less.

Ca: 0.02 Mass % or Less

Ca is an element that has almost the same effects as Pb. In order to achieve the effects, it is preferable to contain Ca at 0.0005 mass % or more. Thus, Ca is contained at 0.02 mass % or less. More preferably, the content is in the range of 0.0005 to 0.010 mass %.

Te: 0.05 Mass % or Less

Te is also an element for improving a cutting property like Pb and Ca. However, when Te exceeds 0. 05mass %, the effects do not improve, lowering fatigue resistance. Thus, the content is limited to 0.05 mass % or less.

Co: 0.10 Mass % or Less

Co is also a component having almost the same effects as Pb, Ca and Te. However, when Co exceeds 0.10 mass %, the effects do not improve. Thus, the content is limited to 0.10 mass % or less.

Sb: 0.05 Mass % or Less

Sb is also a component having almost the same effects as Co, Pb, Ca and Te. However, when Sb exceeds 0.05 mass %, the effects do not improve. Thus, the content is limited to 0.05 mass % or less.

Bi: 0.30 Mass % or Less

Bi is also a component having almost the same effects as Sb, Co, Pb, Ca and Te. However, when Bi exceeds 0.05 mass %, the effects do not improve. Thus, the content is limited to 0.05 mass % or less.

Se: Less Than 0.02 Mass %

Se is bonded to Mn, forming MnSe. MnSe works as a chip breaker, and improves machinability. However, the addition of 0.02 mass % or more provides negative effects on fatigue resistance. Thus, Se is contained at less than 0.02 mass %.

Moreover, the components mentioned above achieve the effects even when they are added in a small content at 0.002 mass %.

In the invention, in addition to the adjustment of components in the above-noted ranges, the steel structure should be bainitic containing block structures at 10% or more in area ratios.

This is because high toughness cannot be obtained in a ferrite structure when crystal grains become large. On the other hand, in the case of a martensitic structure, the range of cooling rates is narrow, and the dependency of the structure and hardness on cooling ratios increases. Moreover, as the block structures are contained at 10% or more in area ratios, bainite can be subdivided and toughness improves.

Additionally, in order to provide a bainitic structure containing block structures as a steel structure, Cu may be added, and cooling may be carried out within the cooling rate range of 0.001° C./s or higher, particularly in a cooling process during production.

Subsequently, the production of the invention will be explained.

Blooms are made from molten steel having the preferable compositions mentioned above, normally by an ingot making method or a continuous casting method.

Then, bloom heating is carried out. The heating temperature is in the range of 1000 to 1250° C. In order to effectively utilize the precipitation strengthening of Cu and to act with S, it is necessary to thoroughly solid-solve Cu. Therefore, it is important to heat at the temperature of 1000 to 1250° C.

Then, hot rolling is carried out at the temperature of 850° C. or above and 30% or more total reduction of cross-sectional area. This is because not only MnS but also microstructure anisotropy has to be reduced so as to decrease material anisotropy. For this, austenite grains before transformation should be equi-axed recrystallized grains. Therefore, rolling finishing temperature should be 850° C. or above at the recrystallization region of austenite grains, and working at 30% or more total reduction of cross-sectional area should be carried out.

Subsequently, cooling is carried out at the cooling rate of 0.001 to 1° C./s at the temperature range of 600 to 300° C. The cooling rate is 0.001° C./s or above herein in order to improve machinability and provide a bainitic structure containing block structures. Moreover, the cooling rate is 1° C./s or below in order to precipitate fine Cu and thus improve strength.

Moreover, the cooling rate mentioned above is a general rate in hot-working this type of steel materials, or a general cooling rate for cooling steel in the atmosphere. In other words, it is unnecessary to carry out specific controlled cooling after rolling in the invention.

Additionally, the temperature range of 600 to 300° C. is a range in which bainite is formed. Therefore, cooling may be carried out at the cooling rate of 0.001 to 1° C./s at least in this temperature range.

As a result, non heat-treated steel having little material anisotropy and having superior strength, toughness and machinability can be obtained.

EXAMPLES

Molten steels having components shown in Table 2 to 4 were melted in a converter, and blooms were prepared by continuous casting. In comparative examples, the components at contents out of the ranges of the invention were indicated with underlining. Then, 84 mm square, 90 mm square, 250 mm square and 500 mm square billets were provided by rough rolling. Hot-rolling was carried out to the billets under the conditions shown in Table 5 to 8. Steel bars of 80 mmϕ, 85 mmϕ, 200 mmϕ, 350 mmϕ were provided and air-cooled. Additionally, controlled cooling was carried out to a portion.

The structures, mechanical properties, impact characteristics and cutting properties of each steel bar obtained thereby were tested. The results are shown in Table 5 to 8.

For structures, samples etched with 3% nital were observed by an optical microscope. Moreover, the area ratio of block structures was calculated from the area of seemingly dark parts for ten visual fields.

Mechanical properties were measured by collecting JIS No. 4 tensile test pieces and carrying out tensile tests.

For impact characteristics, JIS No. 3 impact test pieces were collected from the L direction and C direction, and Charpy test was carried out at 20° C. Charpy impact energy was measured.

In tables, the impact energy of L direction samples, and ratios between the C direction and L direction were shown.

For machinability, tool lifespan was measured in the same test as the one shown in FIG. 2.

Furthermore, as the indicators of machinability, chip treatability was evaluated in the following four categories.

◎: Generation of subdivided chips of 10 mm or shorter length;

○: Generation of subdivided chips of 10 to 15 mm length;

Δ: Partial generation of chips of 15 to 30 mm length; and

×: Continuously generation of chips of 30 mm or longer.

As shown in Table 5 to 8, all the non heat-treated steel of the invention had high strength at TS ≧926 MPa and high toughness at $\upsilon E_{20}$ ≧101 J/cm$^2$. Furthermore, machinability is superior, and material anisotropy is also small.

On the contrary, in the case of steel 49 (No. 59, 60, 61) as a conventional non heat-treated steel, strength and toughness are highly dependent on cooling rates. In other words, the steel 49 of a ferrite-pearlite structure has TS of 894 MPa even when cooling rates are low, and TS does not reach 900 MPa. As cooling rates are lowered, only low TS values can be obtained. Additionally, toughness is about 46 J/cm$^2$ even when cooling rates are high. When cooling rates are low, toughness declines to about 18 J/cm$^2$.

In this sense, steel 48 (No. 56, 57, 58), even as a conventional non heat-treated steel, has a more preferable balance between strength and toughness at any cooling rate than the steel 49. However, the steel 48 has lower strength and toughness than steel 50 (No. 62, 63, 64), steel 51 (No. 65, 66, 67) as conventional non heat-treated steels, and steels of the invention.

In other words, the steel 49 and the steel 48 as comparative examples maybe applicable to small-diameter steel bars in which cooling rates are relatively high, but are not suitable for large-diameter steel bars in which cooling rates are low.

On the contrary, the mechanical properties or toughness of the steel of the invention are little dependent on cooling rates. In other words, even in the case of large-diameter steel bars, enough strength and toughness can be evenly added.

INDUSTRIAL APPLICABILITY

Thus, the present invention fundamentally requires no heat treatment after hot working, and also requires no controls over cooling rates that are different depending on rolling sizes. Superior strength and toughness can be obtained along with preferable machinability and material anisotropy.

Therefore, the non heat-treated steel of the invention has a better balance in strength-toughness than conventional non heat-treated steels. Accordingly, the steel is widely applicable to various types of mechanical parts, ranging from important safety parts for vehicles that require high strength and high toughness, to shafts, rolling parts and sliding parts.

TABLE 2

| Steel | Components (mass %) | | | | | | | | | | | | | |
|---|---|---|---|---|---|---|---|---|---|---|---|---|---|---|
| No. | C | Si | Mn | S | Cu | Ni | Cr | Al | Ti | B | N | O | Others | Remarks |
| 1 | 0.065 | 0.25 | 3.01 | 0.005 | 1.06 | 1.02 | 0.53 | 0.036 | 0.020 | 0.0015 | 0.0035 | 0.0022 | — | Present |
| 2 | 0.096 | 0.26 | 2.97 | 0.005 | 1.08 | 0.98 | 0.55 | 0.033 | 0.021 | 0.0022 | 0.0048 | 0.0021 | — | invention |
| 3 | 0.070 | 0.49 | 2.95 | 0.005 | 1.97 | 0.97 | 0.60 | 0.030 | 0.020 | 0.0020 | 0.0033 | 0.0028 | — | |
| 4 | 0.082 | 0.27 | 4.80 | 0.004 | 1.11 | 1.12 | 0.63 | 0.025 | 0.022 | 0.0010 | 0.0042 | 0.0020 | — | |
| 5 | 0.065 | 0.33 | 2.49 | 0.019 | 1.48 | 0.96 | 0.21 | 0.041 | 0.018 | 0.0008 | 0.0045 | 0.0022 | — | |
| 6 | 0.071 | 0.22 | 2.98 | 0.004 | 2.78 | 0.54 | 0.50 | 0.038 | 0.020 | 0.0030 | 0.0038 | 0.0021 | — | |
| 7 | 0.081 | 0.26 | 3.00 | 0.004 | 2.00 | 2.90 | 0.65 | 0.032 | 0.017 | 0.0016 | 0.0040 | 0.0028 | — | |
| 8 | 0.075 | 0.24 | 3.10 | 0.003 | 1.05 | 1.01 | 1.75 | 0.045 | 0.020 | 0.0032 | 0.0040 | 0.0020 | — | |
| 9 | 0.080 | 0.25 | 3.11 | 0.002 | 2.06 | 0.57 | 0.45 | 0.044 | 0.022 | 0.0013 | 0.0042 | 0.0028 | — | |
| 10 | 0.071 | 0.27 | 2.92 | 0.004 | 1.23 | 0.59 | 0.46 | 0.039 | 0.090 | 0.0015 | 0.0045 | 0.0031 | — | |
| 11 | 0.066 | 0.25 | 3.10 | 0.004 | 1.48 | 0.77 | 0.45 | 0.030 | 0.020 | 0.0240 | 0.0038 | 0.0020 | — | |
| 12 | 0.062 | 0.26 | 3.05 | 0.003 | 1.65 | 0.86 | 0.11 | 0.028 | 0.022 | 0.0030 | 0.0185 | 0.0028 | — | |
| 13 | 0.080 | 0.26 | 2.90 | 0.005 | 1.12 | 0.62 | 1.95 | 0.031 | 0.021 | 0.0022 | 0.0042 | 0.0054 | — | |
| 14 | 0.085 | 0.26 | 2.96 | 0.005 | 1.15 | 0.58 | 0.70 | 0.035 | 0.012 | 0.0021 | 0.0044 | 0.0031 | Nb:0.038 | |
| 15 | 0.091 | 0.24 | 2.50 | 0.005 | 1.10 | 0.78 | 0.66 | 0.005 | 0.076 | 0.0010 | 0.0044 | 0.0027 | Mo:0.38 | |
| 16 | 0.081 | 0.24 | 3.21 | 0.004 | 1.08 | 0.96 | 0.65 | 0.071 | 0.021 | 0.0025 | 0.0043 | 0.0026 | V:0.16 | |
| 17 | 0.080 | 0.28 | 2.92 | 0.004 | 1.36 | 0.95 | 0.70 | 0.032 | 0.027 | 0.0020 | 0.0039 | 0.0027 | W:0.031 | |

TABLE 3

| Steel | Components (mass %) | | | | | | | | | | | | | |
|---|---|---|---|---|---|---|---|---|---|---|---|---|---|---|
| No. | C | Si | Mn | S | Cu | Ni | Cr | Al | Ti | B | N | O | Others | Remarks |
| 18 | 0.075 | 0.26 | 2.96 | 0.005 | 1.45 | 0.96 | 0.69 | 0.035 | 0.021 | 0.0024 | 0.0045 | 0.0033 | Zr:0.015 | Present |
| 19 | 0.072 | 0.32 | 3.11 | 0.006 | 1.65 | 0.95 | 0.65 | 0.034 | 0.021 | 0.0023 | 0.0044 | 0.0031 | Mg:0.018 | invention |
| 20 | 0.069 | 0.32 | 2.58 | 0.004 | 1.33 | 0.82 | 0.62 | 0.030 | 0.019 | 0.0017 | 0.0042 | 0.0026 | Hf:0.024 | |
| 21 | 0.077 | 0.25 | 2.98 | 0.005 | 1.32 | 1.42 | 0.58 | 0.035 | 0.022 | 0.0020 | 0.0039 | 0.0042 | REM:0.02 | |
| 22 | 0.080 | 0.25 | 3.12 | 0.006 | 1.07 | 1.04 | 0.50 | 0.033 | 0.017 | 0.0011 | 0.0048 | 0.0012 | P:0.023 | |
| 23 | 0.072 | 0.30 | 3.08 | 0.007 | 1.15 | 0.88 | 0.49 | 0.035 | 0.020 | 0.0030 | 0.0045 | 0.0011 | Pb:0.21 | |
| 24 | 0.070 | 0.35 | 2.99 | 0.014 | 1.19 | 0.74 | 0.60 | 0.030 | 0.022 | 0.0029 | 0.0044 | 0.0013 | Ca:0.002 | |
| 25 | 0.071 | 0.32 | 2.98 | 0.012 | 1.07 | 0.69 | 0.65 | 0.029 | 0.025 | 0.0021 | 0.0050 | 0.0011 | Te:0.009 | |
| 26 | 0.065 | 0.27 | 2.98 | 0.016 | 1.14 | 0.78 | 0.71 | 0.033 | 0.020 | 0.0014 | 0.0036 | 0.0025 | Se:0.018 | |
| 27 | 0.066 | 0.28 | 3.05 | 0.008 | 1.16 | 0.74 | 0.72 | 0.036 | 0.017 | 0.0024 | 0.0033 | 0.0026 | Sb:0.02 | |
| 28 | 0.074 | 0.29 | 3.01 | 0.003 | 1.14 | 0.72 | 0.54 | 0.037 | 0.017 | 0.0026 | 0.0036 | 0.0024 | Bi:0.03 | |
| 29 | 0.040 | 0.31 | 2.99 | 0.010 | 1.16 | 0.69 | 0.55 | 0.041 | 0.019 | 0.0023 | 0.0045 | 0.0026 | — | Comparative |
| 30 | 0.140 | 0.28 | 2.98 | 0.012 | 1.28 | 0.63 | 0.51 | 0.088 | 0.022 | 0.0015 | 0.0052 | 0.0022 | — | example |
| 31 | 0.071 | 1.20 | 2.96 | 0.014 | 1.33 | 0.65 | 0.50 | 0.045 | 0.023 | 0.0018 | 0.0048 | 0.0025 | — | |

TABLE 3-continued

| Steel | Components (mass %) | | | | | | | | | | | | | |
|---|---|---|---|---|---|---|---|---|---|---|---|---|---|---|
| No. | C | Si | Mn | S | Cu | Ni | Cr | Al | Ti | B | N | O | Others | Remarks |
| 32 | 0.070 | 0.33 | 1.80 | 0.003 | 1.32 | 0.87 | 0.69 | 0.035 | 0.024 | 0.0025 | 0.0047 | 0.0026 | | |
| 33 | 0.071 | 0.38 | 5.50 | 0.005 | 1.14 | 0.59 | 0.55 | 0.034 | 0.020 | 0.0009 | 0.0040 | 0.0020 | — | |
| 34 | 0.069 | 0.31 | 2.98 | 0.040 | 1.15 | 1.05 | 0.52 | 0.065 | 0.021 | 0.0022 | 0.0041 | 0.0029 | — | |

TABLE 4

| Steel | Components (mass %) | | | | | | | | | | | | | |
|---|---|---|---|---|---|---|---|---|---|---|---|---|---|---|
| No. | C | Si | Mn | S | Cu | Ni | Cr | Al | Ti | B | N | O | Others | Remarks |
| 35 | 0.077 | 0.25 | 2.99 | 0.006 | 0.52 | 2.29 | 0.53 | 0.035 | 0.021 | 0.0020 | 0.0040 | 0.0022 | — | Comparative example |
| 36 | 0.070 | 0.24 | 2.98 | 0.007 | 3.60 | 0.37 | 0.60 | 0.034 | 0.020 | 0.0018 | 0.0041 | 0.0054 | — | |
| 37 | 0.071 | 0.32 | 2.97 | 0.005 | 1.65 | 3.10 | 0.62 | 0.033 | 0.019 | 0.0025 | 0.0039 | 0.0022 | — | |
| 38 | 0.066 | 0.26 | 3.04 | 0.005 | 1.24 | 0.54 | 0.008 | 0.036 | 0.018 | 0.0023 | 0.0045 | 0.0023 | — | |
| 39 | 0.069 | 0.25 | 3.02 | 0.003 | 1.18 | 0.56 | 2.30 | 0.035 | 0.021 | 0.0030 | 0.0048 | 0.0021 | — | |
| 40 | 0.071 | 0.26 | 3.11 | 0.004 | 1.19 | 0.52 | 0.55 | 0.120 | 0.022 | 0.0035 | 0.0043 | 0.0028 | — | |
| 41 | 0.070 | 0.25 | 3.01 | 0.006 | 1.23 | 0.54 | 0.48 | 0.035 | 0.005 | 0.0020 | 0.0044 | 0.0032 | — | |
| 42 | 0.070 | 0.22 | 2.95 | 0.004 | 1.22 | 0.58 | 0.44 | 0.033 | 0.160 | 0.0018 | 0.0038 | 0.0027 | — | |
| 43 | 0.064 | 0.28 | 2.89 | 0.005 | 1.12 | 0.56 | 0.70 | 0.041 | 0.035 | 0.0001 | 0.0042 | 0.0029 | — | |
| 44 | 0.075 | 0.25 | 3.06 | 0.004 | 1.45 | 2.20 | 0.53 | 0.044 | 0.022 | 0.0410 | 0.0042 | 0.0029 | — | |
| 45 | 0.090 | 0.27 | 3.01 | 0.006 | 1.54 | 1.95 | 0.56 | 0.028 | 0.018 | 0.0022 | 0.0008 | 0.0031 | — | |
| 46 | 0.076 | 0.25 | 2.96 | 0.004 | 1.65 | 1.41 | 0.60 | 0.033 | 0.019 | 0.0024 | 0.0250 | 0.0035 | — | |
| 47 | 0.082 | 0.22 | 2.85 | 0.005 | 1.25 | 1.25 | 0.49 | 0.032 | 0.020 | 0.0015 | 0.0045 | 0.0078 | — | |
| 48 | 0.02 | 1.24 | 1.53 | 0.055 | 0.45 | — | 0.21 | 0.002 | 0.020 | — | 0.0030 | 0.0031 | V:0.15, Nb:0.012 P:0.017 | |
| 49 | 0.45 | 0.25 | 1.35 | 0.045 | — | — | — | 0.001 | — | — | 0.0031 | 0.0034 | V:0.12, P:0.015 | |
| 50 | 0.35 | 0.22 | 0.75 | 0.012 | 0.02 | 0.04 | 1.10 | 0.035 | — | — | — | 0.0029 | Mo:0.21, P:0.012 | |
| 51 | 0.42 | 0.25 | 0.85 | 0.018 | 0.01 | 0.03 | 1.09 | 0.025 | — | — | — | 0.0027 | Mo:0.23, P:0.011 | |

TABLE 5

| No. | Steel No. | Billet size (mm) | Diameter of steel bar (mm ϕ) | Reduction of cross-sectional area (%) | Cooling ratio after hot rolling (° C./s) | Heat treat-treatment | Micro-structure | Area ratio of block structure (%) | YS (MPa) | TS (MPa) | YR (%) |
|---|---|---|---|---|---|---|---|---|---|---|---|
| 1 | 1 | 90 | 80 | 38.0 | 0.24 | — | Bainite | 56 | 842 | 1057 | 0.78 |
| 2 | 1 | 250 | 200 | 49.8 | 0.08 | — | Bainite | 51 | 829 | 1041 | 0.80 |
| 3 | 1 | 500 | 350 | 61.5 | 0.002 | — | Bainite | 44 | 825 | 1036 | 0.80 |
| 4 | 1 | 84 | 80 | 28.8 | 0.08 | — | Bainite | 42 | 719 | 1025 | 0.66 |
| 5 | 1 | 250 | 80 | 92.0 | 0.95 | — | Bainite | 58 | 758 | 1064 | 0.81 |
| 6 | 1 | 500 | 80 | 98.0 | 0.08 | — | Ferrite | 0 | 578 | 694 | 0.82 |
| 7 | 1 | 90 | 80 | 38.0 | 1.3 | — | Marten- | 98 | 604 | 785 | 0.78 |
| 8 | 2 | 250 | 80 | 92.0 | 0.24 | — | Bainite | 63 | 769 | 1068 | 0.81 |
| 9 | 2 | 500 | 200 | 87.4 | 0.08 | — | Bainite | 61 | 748 | 1054 | 0.78 |
| 10 | 2 | 500 | 350 | 61.5 | 0.04 | — | Bainite | 48 | 729 | 1039 | 0.79 |
| 11 | 3 | 250 | 200 | 49.8 | 0.08 | — | Bainite | 34 | 781 | 1055 | 0.79 |
| 12 | 4 | 250 | 200 | 49.8 | 0.08 | — | Bainite | 82 | 1049 | 1457 | 0.81 |
| 13 | 5 | 250 | 200 | 49.8 | 0.08 | — | Bainite | 13 | 698 | 926 | 0.80 |
| 14 | 6 | 250 | 200 | 49.8 | 0.08 | — | Bainite | 42 | 727 | 1010 | 0.79 |
| 15 | 7 | 250 | 200 | 49.8 | 0.08 | — | Bainite | 92 | 882 | 1242 | 0.79 |
| 16 | 8 | 250 | 200 | 49.8 | 0.08 | — | Bainite | 88 | 943 | 1275 | 0.81 |
| 17 | 9 | 250 | 200 | 49.8 | 0.08 | — | Bainite | 52 | 746 | 1037 | 0.81 |
| 18 | 10 | 250 | 200 | 49.8 | 0.08 | — | Bainite | 38 | 717 | 996 | 0.78 |

| No. | EI (%) | RA (%) | $uE_{20}$ ($J/cm^2$) | Material aniso-tropy (C/L) | Tool life span (s) | Chip treata-bility | Remarks |
|---|---|---|---|---|---|---|---|
| 1 | 21 | 68 | 148 | 0.95 | 1012 | ⊙ | Example |
| 2 | 21 | 68 | 134 | 0.94 | 1027 | ⊙ | |
| 3 | 21 | 68 | 142 | 0.96 | 1033 | ⊙ | |
| 4 | 21 | 67 | 63 | 0.74 | 1043 | ⊙ | Compara-tive |

TABLE 5-continued

| | | | | | | | |
|---|---|---|---|---|---|---|---|
| | | | | | | | example |
| 5 | 21 | 67 | 140 | 0.93 | 1005 | ⊚ | Example |
| 6 | 25 | 67 | 44 | 0.54 | 1364 | Δ | Compara- |
| 7 | 24 | 62 | 33 | 0.49 | 1276 | Δ | tive |
| | | | | | | | example |
| 8 | 21 | 67 | 132 | 0.49 | 1001 | ⊚ | Example |
| 9 | 21 | 67 | 148 | 0.95 | 1015 | ⊚ | |
| 10 | 21 | 67 | 133 | 0.90 | 1029 | ⊚ | |
| 11 | 21 | 67 | 153 | 0.92 | 1014 | ⊚ | |
| 12 | 16 | 62 | 253 | 0.92 | 624 | ⊚ | |
| 13 | 22 | 70 | 101 | 0.94 | 1139 | ⊚ | |
| 14 | 21 | 68 | 135 | 0.95 | 1058 | ⊚ | |
| 15 | 19 | 62 | 192 | 0.90 | 833 | ⊚ | |
| 16 | 18 | 67 | 201 | 0.95 | 801 | ⊚ | |
| 17 | 21 | 62 | 143 | 0.94 | 1031 | ⊚ | |
| 18 | 22 | 67 | 131 | 0.96 | 1071 | ⊚ | |

TABLE 6

| No. | Steel No. | Billet size (mm) | Diameter of steel bar (mm ϕ) | Reduction of cross-section-al area (%) | Cooling ratio after hot rolling (° C./s) | Heat treat-treatment | Micro-struc-ture | Area ratio of block structure (%) | YS (MPa) | TS (MPa) | YR (%) |
|---|---|---|---|---|---|---|---|---|---|---|---|
| 19 | 11 | 250 | 200 | 49.8 | 0.08 | — | Bainite | 40 | 772 | 1043 | 0.79 |
| 20 | 12 | 250 | 200 | 49.8 | 0.08 | — | Bainite | 38 | 708 | 984 | 0.79 |
| 21 | 13 | 250 | 200 | 49.8 | 0.08 | — | Bainite | 91 | 890 | 1236 | 0.78 |
| 22 | 14 | 250 | 200 | 49.8 | 0.08 | — | Bainite | 56 | 756 | 1050 | 0.77 |
| 23 | 15 | 250 | 85 | 90.9 | 0.24 | — | Bainite | 51 | 739 | 1041 | 0.79 |
| 24 | 16 | 250 | 200 | 49.8 | 0.08 | — | Bainite | 74 | 830 | 1122 | 0.78 |
| 25 | 17 | 250 | 200 | 49.8 | 0.08 | — | Bainite | 57 | 770 | 1069 | 0.78 |
| 26 | 18 | 250 | 85 | 90.9 | 0.24 | — | Bainite | 68 | 795 | 1074 | 0.78 |
| 27 | 19 | 250 | 85 | 90.9 | 0.24 | — | Bainite | 62 | 778 | 1095 | 0.79 |
| 28 | 20 | 250 | 200 | 49.8 | 0.08 | — | Bainite | 31 | 698 | 970 | 0.80 |
| 29 | 21 | 250 | 200 | 49.8 | 0.08 | — | Bainite | 65 | 792 | 1100 | 0.80 |
| 30 | 22 | 250 | 200 | 49.8 | 0.08 | — | Bainite | 61 | 804 | 1086 | 0.81 |
| 31 | 23 | 250 | 200 | 49.8 | 0.08 | — | Bainite | 54 | 751 | 1058 | 0.82 |
| 32 | 24 | 250 | 200 | 49.8 | 0.08 | — | Bainite | 48 | 773 | 1044 | 0.78 |
| 33 | 25 | 250 | 200 | 49.8 | 0.08 | — | Bainite | 51 | 753 | 1046 | 0.79 |
| 34 | 26 | 250 | 200 | 49.8 | 0.08 | — | Bainite | 55 | 784 | 1060 | 0.77 |
| 35 | 27 | 250 | 200 | 49.8 | 0.08 | — | Bainite | 62 | 762 | 1073 | 0.78 |
| 36 | 28 | 250 | 200 | 49.8 | 0.08 | — | Bainite | 48 | 748 | 1039 | 0.79 |

| No. | EI (%) | RA (%) | $uE_{20}$ ($J/cm^2$) | Material aniso-tropy (C/L) | Tool life span (s) | Chip treata-bility | Remarks |
|---|---|---|---|---|---|---|---|
| 19 | 21 | 67 | 134 | 0.95 | 1026 | ⊚ | Example |
| 20 | 22 | 69 | 128 | 0.93 | 1083 | ⊚ | |
| 21 | 19 | 63 | 190 | 0.94 | 838 | ⊚ | |
| 22 | 21 | 67 | 136 | 0.92 | 1019 | ⊚ | |
| 23 | 21 | 67 | 146 | 0.92 | 1028 | ⊚ | |
| 24 | 20 | 65 | 157 | 0.95 | 949 | ⊚ | |
| 25 | 21 | 67 | 152 | 0.94 | 1000 | ⊚ | |
| 26 | 21 | 66 | 143 | 0.93 | 996 | ⊚ | |
| 27 | 20 | 66 | 149 | 0.92 | 975 | ⊚ | |
| 28 | 22 | 69 | 134 | 0.92 | 1096 | ⊚ | |
| 29 | 20 | 66 | 151 | 0.94 | 970 | ⊚ | |
| 30 | 21 | 66 | 147 | 0.95 | 984 | ⊚ | |
| 31 | 21 | 67 | 139 | 0.90 | 1011 | ⊚ | |
| 32 | 21 | 67 | 155 | 0.91 | 1025 | ⊚ | |
| 33 | 21 | 67 | 135 | 0.92 | 1023 | ⊚ | |
| 34 | 21 | 67 | 149 | 0.93 | 1009 | ⊚ | |
| 35 | 21 | 67 | 143 | 0.95 | 996 | ⊚ | |
| 36 | 21 | 66 | 123 | 0.92 | 1029 | ⊚ | |

TABLE 7

| Steel | Billet size | Diameter of steel bar | Reduction of cross-section-al area | Cooling ratio after hot rolling | Heat treat- | Micro-struc- | Area ratio of block structure | YS | TS | YR |
|---|---|---|---|---|---|---|---|---|---|---|

TABLE 7-continued

| No. | No. | (mm) | (mm ϕ) | (%) | (° C./s) | treatment | ture | (%) | (MPa) | (MPa) | (%) |
|---|---|---|---|---|---|---|---|---|---|---|---|
| 37 | 29 | 250 | 200 | 49.8 | 0.08 | — | Bainite | 8 | 658 | 875 | 0.75 |
| 38 | 30 | 250 | 200 | 49.8 | 0.08 | — | Bainite | 5 | 989 | 1578 | 0.63 |
| 39 | 31 | 250 | 200 | 49.8 | 0.08 | — | Bainite | 3 | 731 | 1015 | 0.72 |
| 40 | 32 | 250 | 200 | 49.8 | 0.08 | — | Bainite | 9 | 594 | 794 | 0.75 |
| 41 | 33 | 250 | 200 | 49.8 | 0.08 | — | Bainite | 4 | 1091 | 1536 | 0.71 |
| 42 | 34 | 250 | 200 | 49.8 | 0.08 | — | Bainite | 28 | 759 | 1055 | 0.72 |
| 43 | 35 | 250 | 200 | 49.8 | 0.08 | — | Bainite | 5 | 487 | 786 | 0.62 |
| 44 | 36 | 250 | 200 | 49.8 | 0.08 | — | Bainite | 4 | 718 | 1011 | 0.71 |
| 45 | 37 | 250 | 200 | 49.8 | 0.08 | — | Bainite | 72 | 894 | 1242 | 0.72 |
| 46 | 38 | 250 | 200 | 49.8 | 0.08 | — | Bainite | 5 | 452 | 696 | 0.65 |
| 47 | 39 | 250 | 200 | 49.8 | 0.08 | — | Bainite | 1 | 926 | 1192 | 0.78 |
| 48 | 40 | 250 | 200 | 49.8 | 0.08 | — | Bainite | 5 | 772 | 1043 | 0.74 |
| 49 | 41 | 250 | 200 | 49.8 | 0.08 | — | Bainite | 5 | 719 | 1012 | 0.71 |
| 50 | 42 | 250 | 200 | 49.8 | 0.08 | — | Bainite | 2 | 718 | 997 | 0.72 |
| 51 | 43 | 250 | 200 | 49.8 | 0.08 | — | Bainite | 3 | 593 | 725 | 0.82 |
| 52 | 44 | 250 | 200 | 49.8 | 0.08 | — | Bainite | 31 | 868 | 1124 | 0.77 |

| No. | EI (%) | RA (%) | $uE_{20}$ ($J/cm^2$) | Material aniso-tropy (C/L) | Tool life span (s) | Chip treata-bility | Remarks |
|---|---|---|---|---|---|---|---|
| 37 | 23 | 66 | 28 | 0.58 | 1189 | Δ | Compara- |
| 38 | 15 | 48 | 42 | 0.83 | 98 | x | tive |
| 39 | 21 | 63 | 19 | 0.74 | 1053 | Δ | example |
| 40 | 24 | 68 | 33 | 0.75 | 1267 | ○ | |
| 41 | 16 | 60 | 26 | 0.74 | 247 | Δ | |
| 42 | 21 | 62 | 138 | 0.28 | 1014 | ○ | |
| 43 | 24 | 64 | 43 | 0.61 | 1275 | x | |
| 44 | 21 | 63 | 12 | 0.78 | 1057 | ○ | |
| 45 | 19 | 63 | 192 | 0.79 | 833 | ○ | |
| 46 | 25 | 61 | 63 | 0.74 | 1362 | Δ | |
| 47 | 19 | 59 | 18 | 0.72 | 272 | x | |
| 48 | 21 | 62 | 38 | 0.71 | 126 | x | |
| 49 | 21 | 63 | 29 | 0.74 | 156 | x | |
| 50 | 22 | 63 | 13 | 0.74 | 270 | x | |
| 51 | 25 | 60 | 28 | 0.78 | 1334 | Δ | |
| 52 | 20 | 60 | 158 | 0.77 | 947 | ○ | |

TABLE 8

| No. | Steel No. | Billet size (mm) | Diameter of steel bar (mm ϕ) | Reduction of cross-section-al area (%) | Cooling ratio after hot rolling (° C./s) | Heat treat-treatment | Micro-struc-ture | Area ratio of block structure (%) | YS (MPa) | TS (MPa) | YR (%) |
|---|---|---|---|---|---|---|---|---|---|---|---|
| 53 | 45 | 250 | 200 | 49.8 | 0.08 | — | Bainite | 2 | 820 | 1155 | 0.71 |
| 54 | 46 | 250 | 200 | 49.8 | 0.08 | — | Bainite | 1 | 812 | 1098 | 0.74 |
| 55 | 47 | 250 | 200 | 49.5 | 0.08 | — | Bainite | 28 | 744 | 1048 | 0.71 |
| 56 | 48 | 250 | 85 | 90.9 | 0.24 | — | Bainite | 6 | 608 | 923 | 0.66 |
| 57 | 48 | 500 | 200 | 87.4 | 0.08 | — | Bainite | 8 | 582 | 874 | 0.67 |
| 58 | 48 | 500 | 350 | 61.5 | 0.04 | — | Bainite | 5 | 553 | 808 | 0.68 |
| 59 | 49 | 250 | 85 | 90.9 | 0.24 | — | Ferrite-pearlite | 5 | 596 | 894 | 0.67 |
| 60 | 49 | 500 | 200 | 87.4 | 0.08 | — | Ferrite-pearlite | 6 | 564 | 823 | 0.69 |
| 61 | 49 | 500 | 350 | 61.5 | 0.04 | — | Ferrite-pearlite | 7 | 512 | 783 | 0.65 |
| 62 | 50 | 250 | 85 | 90.9 | 0.24 | Q:880° C. T:580° C. | Tempered marteneite | 13 | 795 | 963 | 0.83 |
| 63 | 50 | 500 | 200 | 87.4 | 0.08 | Q:880° C. T:580° C. | Tempered martensite | 11 | 764 | 926 | 0.83 |
| 64 | 50 | 500 | 350 | 61.5 | 0.04 | Q:880° C. T:580° C. | Tempered martensite | 9 | 694 | 818 | 0.85 |
| 65 | 51 | 250 | 85 | 90.9 | 0.24 | Q:880° C. T:580° C. | Tempered martensite | 14 | 863 | 1042 | 0.83 |
| 66 | 51 | 500 | 200 | 87.4 | 0.08 | Q:880° C. T:580° C. | Tempered martensite | 18 | 821 | 1008 | 0.81 |
| 67 | 51 | 500 | 350 | 61.5 | 0.04 | Q:880° C. T:580° C. | Tempered martensite | 12 | 765 | 948 | 0.81 |

Material aniso- Tool life Chip

TABLE 8-continued

| No. | EI (%) | RA (%) | $uE_{20}$ ($J/cm^2$) | tropy (C/L) | span (s) | treata-bility | Remarks |
|---|---|---|---|---|---|---|---|
| 53 | 20 | 60 | 31 | 0.76 | 917 | Δ | Compara- |
| 54 | 20 | 61 | 9 | 0.74 | 972 | Δ | tive |
| 55 | 21 | 62 | 29 | 0.73 | 1021 | Δ | example |
| 56 | 15 | 55 | 58 | 0.24 | 86 | x | |
| 57 | 16 | 56 | 32 | 0.26 | 92 | x | |
| 58 | 15 | 54 | 25 | 0.25 | 107 | x | |
| 59 | 16 | 56 | 46 | 0.27 | 71 | x | |
| 60 | 17 | 58 | 22 | 0.28 | 85 | x | |
| 61 | 17 | 58 | 18 | 0.27 | 96 | x | |
| 62 | 18 | 63 | 111 | 0.64 | 263 | Δ | |
| 63 | 18 | 63 | 101 | 0.65 | 284 | Δ | |
| 64 | 19 | 62 | 81 | 0.65 | 318 | Δ | |
| 65 | 18 | 63 | 134 | 0.63 | 207 | Δ | |
| 66 | 19 | 62 | 124 | 0.64 | 248 | Δ | |
| 67 | 19 | 63 | 107 | 0.65 | 301 | Δ | |

What is claimed is:

1. A non heat-treated steel that has small material anisotropy, and excellent strength, toughness and machinability, containing:

C: more than 0.05 mass % to less than 0.10 mass %; Si: 1.0 mass % or less;

Mn: more than 2.2 mass % to 5.0 mass %; S: less than 0.020 mass %;

Cu: more than 1.0 mass % to 3.0 mass %; Ni: 3.0 mass % or less;

Cr: 0.01 to 2.0 mass %; Al: 0.1 mass % or less;

Ti: 0.01 to 0.10 mass %; B: 0.0003 to 0.03 mass %;

N: 0.0010 to 0.0200 mass %; 0: 0.0060 mass % or less ; and the balance Fe and inevitable impurities; wherein a steel structure is bainitic having block structures at 10% or more in area ratios.

2. The non heat-treated steel that has small material anisotropy, and excellent strength, toughness and machinability according to claim 1, wherein the steel further contains one kind or two kinds selected from the group consisting of:

Mo: 1.0 mass % or less; and Nb: 0.5 mass % or less.

3. The non heat-treated steel that has small material anisotropy, and excellent strength, toughness and machinability according to claim 1, wherein the steel further contains one kind or two kinds selected from the group consisting of:

V: 0.5 mass % or less; and W: 0.5 mass % or less.

4. The non heat-treated steel that has small material anisotropy, and excellent strength, toughness and machinability according to claim 1, wherein the steel further contains one kind or more kinds selected from the group consisting of:

Zr: 0.02 mass % or less; Mg: 0.02 mass % or less;

Hf: 0.10 mass % or less; and REM: 0.02 mass % or less.

5. The non heat-treated steel that has small material anisotropy, and excellent strength, toughness and machinability according to claim 1, wherein the steel further contains one or more kinds selected from the group consisting of:

P: 0.10 mass % or less; Pb: 0.30 mass % or less;

Co: 0.1 mass % or less; Ca: 0.02 mass % or less;

Te: 0.05 mass % or less; Se: less than 0.02 mass %

Sb: 0.05 mass % or less; and Bi: 0.30 mass % or less.

6. A production of non heat-treated steel having small material anisotropy and excellent strength, toughness and machinability; wherein after heating steel at 1000 to 1250° C., containing:

C: more than 0.05 mass % to less than 0.10 mass %; Si: 1.0 mass % or less;

Mn: more than 2.2 mass % to 5.0 mass %; S: less than 0.020 mass %;

Cu: more than 1.0 mass % to 3.0 mass %; Ni: 3.0 mass % or less;

Cr: 0.01 to 2.0 mass %; Al: 0.1 mass % or less;

Ti: 0.01 to 0.10 mass %; B: 0.0003 to 0.03 mass %;

N: 0.0010 to 0.0200 mass %; 0: 0.0060 mass % or less; and the balance Fe and inevitable impurities, hot working is carried out at 850° C. or above at 30% or more total reduction of cross-sectional area, and the steel is cooled at a cooling ratio of 0.001 to 1° C./s in a temperature range of 600 to 300° C.

7. The production of non heat-treated steel that has small material anisotropy, and excellent strength, toughness and machinability according to claim 6, wherein the steel further contains one kind or two kinds selected from the group consisting of:

Mo: 1.0 mass % or less; and Nb: 0.5 mass % or less.

8. The production of non heat-treated steel that has small material anisotropy, and excellent strength, toughness and machinability according to claim 6, wherein the steel further contains one kind or two kinds selected from the group consisting of:

V: 0.5 mass % or less; and W: 0.5 mass % or less.

9. The production of non heat-treated steel that has small material anisotropy, and excellent strength, toughness and machinability according to claim 6, wherein the steel further contains one kind or more kinds selected from the group consisting of:

Zr: 0.02 mass % or less; Mg: 0.02 mass % or less;

Hf: 0.10 mass % or less; and REM: 0.02 mass % or less.

10. The production of non heat-treated steel that has small material anisotropy, and excellent strength, toughness and machinability according to claim 6, wherein the steel further contains one kind or more kinds selected from the group consisting of:

P: 0.10 mass % or less; Pb: 0.30 mass % or less;

Co: 0.1 mass % or less; Ca: 0.02 mass % or less;

Te: 0.05 mass % or less; Se: less than 0.02 mass %

Sb: 0.05 mass % or less; and Bi: 0.30 mass % or less.

* * * * *